United States Patent [19]

Grant

[11] Patent Number: 4,890,529

[45] Date of Patent: Jan. 2, 1990

[54] LUMINESCENTLY OUTLINED STRING INSTRUMENT

[76] Inventor: Bruce M. Grant, 6701 Sands Point #116, Houston, Tex. 77074

[21] Appl. No.: 244,606

[22] Filed: Sep. 6, 1988

Related U.S. Application Data

[63] Continuation of Ser. No. 61,546, Jun. 15, 1987, abandoned.

[51] Int. Cl.[4] ..... G10D 3/00

[52] U.S. Cl. ..... 84/291; 84/464 A; 362/263

[58] Field of Search ..... 84/291, 293, 464, 464 A, 84/267; 362/263, 86, 800; 40/541, 545, 546

[56] References Cited

U.S. PATENT DOCUMENTS

| | | | |
|---|---|---|---|
| 1,873,584 | 8/1932 | Harris | 40/545 |
| 1,913,233 | 1/1933 | Francesco | 84/464 A |
| 2,092,768 | 9/1937 | Mansell | 40/545 |
| 3,943,815 | 3/1976 | Gilbert | 84/464 A |
| 4,088,050 | 5/1978 | Appel | 84/267 |
| 4,236,191 | 11/1980 | Martinez | 84/464 A |
| 4,313,362 | 2/1982 | Lieber | 84/267 |
| 4,334,452 | 6/1982 | Morrison, III et al. | 84/267 X |
| 4,563,933 | 1/1986 | Kim | 84/464 A |

OTHER PUBLICATIONS

Metro-Goldwyn-Mayer, "That's Dancing!", 1985, at its disclosure of Golddigers of 1933, Shadow Waltz.

*Primary Examiner*—L. T. Hix
*Assistant Examiner*—Brian W. Brown
*Attorney, Agent, or Firm*—Matthews & Associates

[57] ABSTRACT

A luminescently outlined string instrument with an electrical power means for energizing an illumination means, said illumination means mounted about the periphery of the instrument. A means of mounting an illumination means about the periphery of a string instrument. An electrical means for energizing said illumination means disposed within the instrument body or separate from the instrument. A method of illuminating a string instrument by providing a continuous channel above the outer edge of the instrument for insertion of an illumination means about the periphery of the instrument and mounting a power means inside of the instrument or using an outside power source for energizing the illumination means.

10 Claims, 1 Drawing Sheet

FIG. 1
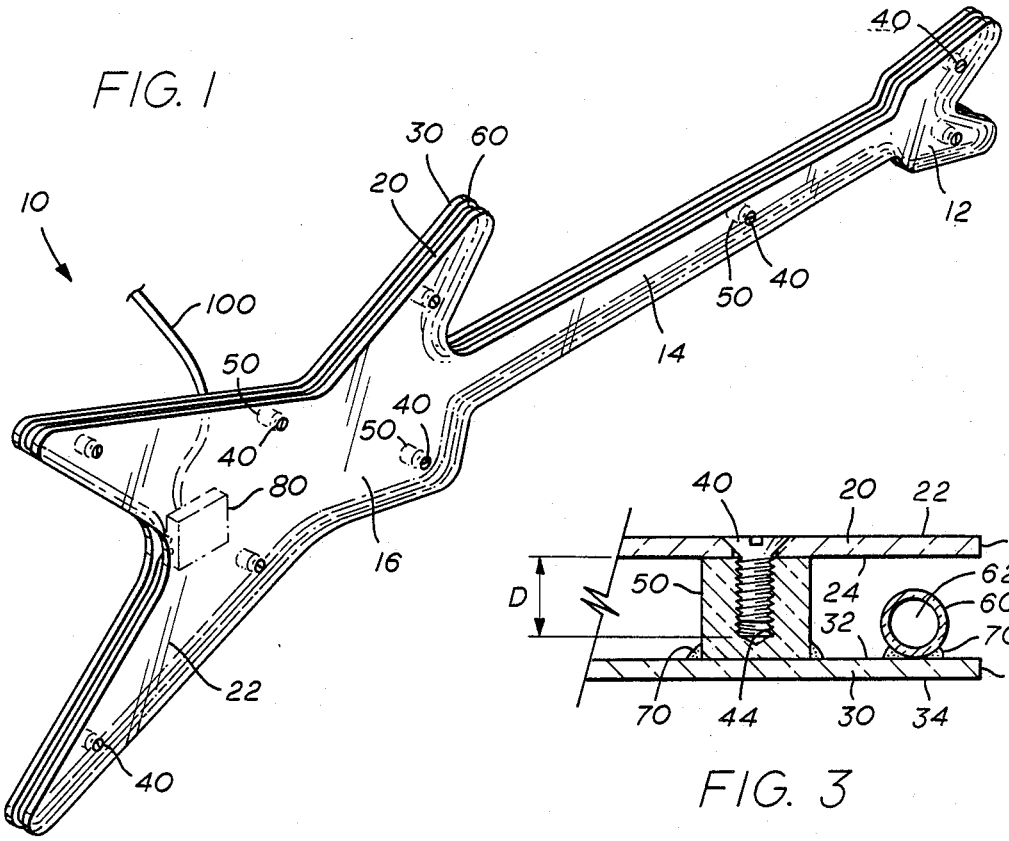
FIG. 3
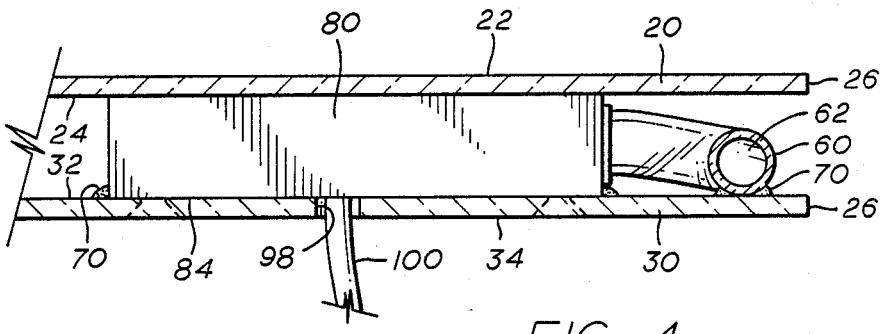
FIG. 4
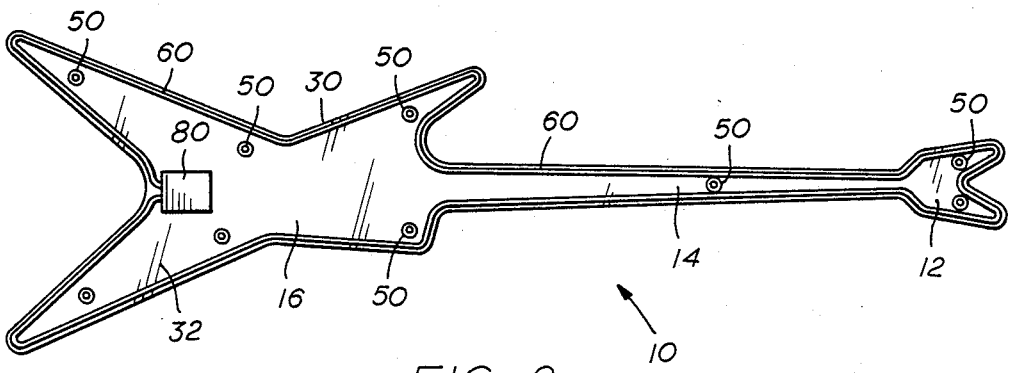
FIG. 2

LUMINESCENTLY OUTLINED STRING INSTRUMENT

This is a continuation of application Ser. No. 061,546 filed June 15, 1987, now abandoned.

BACKGROUND OF THE INVENTION

This invention relates to string instruments and more particularly to electric guitars and stage props. A string instrument such as a guitar, bass, or similar instrument is often pleasing to look at due to the materials used, the design of the instrument itself or the colors that the instrument has been painted or stained. Often these instruments are used in front of thousands of individuals as part of a performance by a musician or musical group. Additionally, guitar-like props are used by individuals or groups who act out "playing" the music in order to visually enhance the playing of pre-recorded music. As show business becomes more technical and visual effects compose a larger part of live performances, it is important, and indeed necessary, to make the instruments as aesthetically exciting as possible.

As electronic power means become smaller and the overall detail of string instruments becomes greater, the use of electric lighting as part of a string instrument for visual enhancement purposes becomes more attractive. Illumination means can be used to outline a particular string instrument. Further, many guitar are now made of plastic, plexiglass, acrylic or other plastic like materials. The use of a plastic like string instrument which is luminescently outlined by neon or other type of light allows for the combination of a musical instrument or musical prop with electronic lighting resulting in unlimited number of color and style combinations.

The following U.S. Patents were considered in the investigation and evaluation of the prior art relative to the existing apparatus used with the invention.

| U.S. Pat. No. | INVENTOR | ISSUED |
|---|---|---|
| 4,563,933 | Kim | January 14, 1986 |
| 4,334,452 | Morrison | June 15, 1982 |
| 4,313,362 | Lieber | February 2, 1982 |
| 4,236,191 | Martinez | November 25, 1980 |
| 4,088,050 | Appel | May 9, 1978 |

OBJECTS OF THE INVENTION

It is an object of this invention to provide a new and improved Luminescently Outlined String Instrument.

It is a further object of this invention to provide a new and improved Luminescently Outlined String Instrument Prop.

It is still a further object of this invention to provide a new and improved method of illuminating a string instrument.

it is also an object of this invention to provide a new and improved method of decorating a string instrument.

It is yet a further object of this invention to provide a new and improved ornamental trimming mounted about the periphery of a string instrument.

SUMMARY OF THE INVENTION

The luminescently outlined string musical instrument described herein comprises a string instrument containing a continuous light source mounted about the periphery of the instrument. Associated with the light source is the electrical power means which can be built into the body of the string instrument or can be separate from the string instrument altogether. When the separate electrical power means is used an electrical cord or cable must connect the electrical power means to a transformer mounted in the guitar which the current passes through prior to travelling to the means of illuminating the string instrument one can use the present invention by merely deleting or not including any of the strings, pegs and other sound creating elements.

The luminiscently outlined string instrument or string instrument prop can be comprised of two separate acrylic plastic panels cut in a guitar shape which are attached to each other in such a way as to provide space between the two sheets to mount the electrical power means at the base of the string instrument body. Further, the space between the two panels would allow for the mounting of the illumination means about the periphery of the instrument. This can be accomplished in such a way so as to protect the illumination means by mounting same between the outer edges of the panels.

The body, neck and peg-head portions of the string instrument are preferably constructed of an acrylic plastic of thickness from about ⅛ to ¼ inch. The open portion between the panels of the instrument is preferably 1 to 1½ inches. The panels, or at least the edges which protrude over the illumination means, are preferably light penetrable.

The means of illumination would typically include neon tubing of any preferred color mounted about the periphery of the entire instrument. The mounting would consist of glue, sealant or any other means to fixably attach the neon tubing between the outer edges of the guitar. While the tubing would be mounted to the outer edge of the guitar, it would still be inset from the outer edge of the front and back sections of the instrument. This provides the protection of the illumination means by the acrylic sheets.

The instrument can be further developed by including the strings and additional electronics to enable the invention to be used as an actual musical instrument. A non-music making instrument silhouette may be outlined with the appropriate illumination means and used as a prop during musical performances or the playing of pre-recorded music.

The foregoing and other objects, features and advantges of the invention will be apparent from the following more particular description of a preferred embodiment of the invention as illustrated in the accompanying drawings.

BRIEF DESCRIPTION OF THE DRAWINGS

FIG. 1 is a perspective showing of a musical instrument prop, in the form of a guitar, incorporating the instant invention.

FIG. 1A is a perspective view of a musical instrument, in the form of a guitar, incorporating the instant invention.

FIG. 2 is a top view of the guitar construction of this invention with the front section removed.

FIG. 3 is a cross sectional view of the neon tubing and the connection point between the front and back pieces.

FIG. 4 is a cross-sectional view of the transformer, neon tubing and the electrical connection between the power means and neon tubing.

DESCRIPTION OF THE PREFERRED EMBODIMENT

Referring to FIG. 1 of the drawings, guitar (10) is illustrated having a body portion (16), a neck portion (14), and a peg-head portion (12). The guitar prop (10) is constructed using a front panel (20) and back panel (30), such panels being of translucent material. Front panel (20) has an outside face (22) and an inside face (24). Back panel (30) also contains an inside face (32) and outside face (34). Each panel both front and back, is of thickness (26). Each panel is cut identical and they are fixably attached to each other by a series of spacer lugs (5) which include a cylindrically threaded cavity (44) of depth (42) better shown in FIG. 3. FIG. 1 also shows that disposed between the panels there is transformer (80) and neon tubing (60) which follows the guitar shape periphery as better shown in FIG. 2. When a totally internal power source, such as batteries is used said power source would be located in the same position.

FIG. 3 shows a screw (40) disposed within cylindrically threaded cavity (44) of depth (D) to be used for holding the front instrument panel (20) to the back instrument panel (30) by being tightened through front section (20) into the cylindrically threaded slot member (44) disposed within spacer lug (50). Spacer lugs (50) are fixably attached to the inside face (32) of the back panel (30). Spacer lugs (50) and screws (40) are intermittently disposed about the prop (10) as shown in FIG. 2. Also displayed in FIG. 3 is a cross-section view of the neon tubing (60). Enclosed within the cavity (62) of said tubing (60) is a gas which may be energized for illumination. Further shown in FIG. 4, the neon tubing (60) and the spacer lugs (50) are both fixably attached to the inside face (32) of the back panel (30) by glue or sealant.

Still further displayed in FIG. 3, as well as 4, is the recessed channel (25) in which the neon tubing (60) is located. The channel (25) is defined by the inside faces of the front and back panels (24) and (32) respectively. This channel (25) is continuous about the periphery of the instrument body of the guitar (10) and protects the neon tubing (60) or other chosen illumination means as well as acting as a possible color altering screen through which the emitted light will, or will not pass.

FIG. 4 is a cross sectional view taken at the base of the instrument body (16) disclosing the transformer (80), neon tubing (60) and the cable (100) through which the current travels in route to transformer (80). The cable (100) passes through a small cylindrical opening (98) of diameter (96) disposed within back panel (30) before entering through the back plate (84) of said power means (80). The front face (86) of the transformer (80) is flat against the inside face (24) of the front panel (20). The current flows into and out of transformer (80), to and from neon tubing (60), through wires (90) which are connected to the transformer (80). The wires (90) connect to the neon tubing (60) in order to transfer the power energizing the gas contained within the neon tubing cavity (62). As noted above, the transformer (80) is merely a transformer of the current brought in through cable (100) with an actual power means located outside of the instrument itself; however, a total internal power source can be substituted instead.

In operation, electrical wire 100 is connected to an electrical power source such as a standard electrical wall outlet. At this time, an illuminous gas contained within cavity (62) of tubing (6) will be energized through the transformer (80). The illuminated neon tube will enhance the guitar shape periphery of the probe, achieving the goal of the present invention.

Thus it is apparent that there has been provided, in accordance with the invention, an apparatus and method to enhance the visual appeal of a string instrument body that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, this patent is intended to embrace all such alternatives, modifications, and variations as fall within the spirit of the invention and scope of the appended claims.

What is claimed is:

1. A luminescently outlined string instrument body comprising:
   a. a string instrument;
   b. a continuous channel disposed just inside of the outer edge of said instrument body;
   c. a continuous illumination source, mounted continuously about the periphery of said instrument within said channel; and
   d. an electrical power means for energizing said illumination source.

2. The apparatus as recited in claim 1 further comprising an electrical power means being positioned within said body of said string instrument.

3. The apparatus as recited in claim 1, further comprising a power means separate from said string instrument, yet connected to the instrument and illumination means by electrical wire or cable.

4. The apparatus as recited in claim 1 further comprising:
   a. separate front and back panels;
   b. a means of attaching said front and back panels to each other with sufficient space between the sections defining said channel for mounting the illumination source; and
   c. said illumination source being intermediately fixably set between front and back panels.

5. The apparatus as recited in claim 4, further comprising an electrical means being positioned within said body of said string instrument between said front and back panels.

6. The apparatus as recited in claim 4, further comprising a power means separate from said string instrument yet connected to said string instrument body by electrical wire or cable.

7. The apparatus as recited in claims 1 or 4 wherein said illumination source is composed of neon tubing.

8. The apparatus of claim 4 comprising said means of attaching said front and back panels of claim 4 wherein a threaded cylindrical receptacle disposed within a spacing lug which is fixably attached to the inside of either the front or back panels of said instrument, said receptacle being capable of accepting a screw or bolt, inserted through a correspondingly aligned aperture in the opposite section of said instrument and tightening said screw or bolt thereby attaching said front and back panels.

9. A method of illuminating a string instrument comprising:
   a. a string instrument body;
   b. a continuous illumination source;
   c. providing a continuous channel about the outer edge of said string instrument sufficiently wide and deep to insert and mount said continuous illumination source in a string instrument;

d. mounting said illumination source in said channel, continuously about the periphery of said instrument body;

e. mounting a power transforming means inside said instrument to properly regulate and transfer power obtained from an outside source to the said illumination means; and f. activating said illumination source from said power means through said transformer.

10. The method as recited in claim 9, further comprising positioning the power means at the base of and within string the instrument.

* * * * *